US009167867B2

(12) United States Patent
Fahmi et al.

(10) Patent No.: US 9,167,867 B2
(45) Date of Patent: Oct. 27, 2015

(54) ARTICLE OF FOOTWEAR WITH MULTI-PART SOLE ASSEMBLY

(75) Inventors: Windra Fahmi, Beaverton, OR (US); Collin K. Eder, Portland, OR (US); Sebastien Mermet, Creteil (FR)

(73) Assignee: NIKE, Inc., Beaverton, OR (US)

( * ) Notice: Subject to any disclaimer, the term of this patent is extended or adjusted under 35 U.S.C. 154(b) by 651 days.

(21) Appl. No.: 12/779,315

(22) Filed: May 13, 2010

(65) Prior Publication Data

US 2011/0277355 A1 Nov. 17, 2011

(51) Int. Cl.

| | |
|---|---|
| ***A43B 7/14*** | (2006.01) |
| ***A43B 23/00*** | (2006.01) |
| ***A43B 5/00*** | (2006.01) |
| ***A43B 13/12*** | (2006.01) |
| ***A43B 3/00*** | (2006.01) |
| ***A43B 13/16*** | (2006.01) |
| ***A43B 13/42*** | (2006.01) |

(52) U.S. Cl.

CPC ..... *A43B 13/127* (2013.01); *A43B 3/0063* (2013.01); *A43B 7/1405* (2013.01); *A43B 13/16* (2013.01); *A43B 13/42* (2013.01)

(58) Field of Classification Search

CPC .. A43B 3/0047; A43B 3/0063; A43B 13/122; A43B 13/125; A43B 13/127; A43B 13/38; A43B 13/386; A43B 13/40; A43B 13/14; A43B 13/16

USPC ..... 36/30 R, 45, 28, 43, 88, 71, 114

See application file for complete search history.

(56) References Cited

U.S. PATENT DOCUMENTS

| | | | | |
|---|---|---|---|---|
| 4,366,634 | A * | 1/1983 | Giese et al. | 36/114 |
| 4,597,196 | A * | 7/1986 | Brown | 36/44 |
| 4,759,136 | A * | 7/1988 | Stewart | A43B 7/14 36/114 |
| 4,759,139 | A * | 7/1988 | Ricks | 40/638 |
| 4,794,707 | A * | 1/1989 | Franklin et al. | 36/107 |
| 4,833,795 | A * | 5/1989 | Diaz | 36/29 |
| 4,947,560 | A * | 8/1990 | Fuerst et al. | 36/88 |
| 5,005,299 | A * | 4/1991 | Whatley | 36/25 R |
| 5,025,573 | A | 6/1991 | Giese et al. | |
| 5,075,984 | A * | 12/1991 | Shiew | 36/113 |
| 5,187,883 | A * | 2/1993 | Penney | 36/35 R |

(Continued)

FOREIGN PATENT DOCUMENTS

| | | |
|---|---|---|
| DE | 7417027 U | 9/1974 |
| DE | 2709546 A1 | 9/1978 |
| EP | 1642512 A1 | 4/2006 |

OTHER PUBLICATIONS

The Engineering ToolBox, Material Properties, Solids and Metals-Specific Gravities, Nov. 2013 http://www.engineeringtoolbox.com/specific-gravity-solids-metals-d_293.html.*

(Continued)

*Primary Examiner* — Robert J Hicks
*Assistant Examiner* — Cameron A Carter
(74) *Attorney, Agent, or Firm* — Banner & Witcoff, Ltd.

(57) ABSTRACT

An article of footwear includes an upper, a midsole beneath the upper, and an outsole beneath the midsole. The midsole includes a substantially U-shaped outer member defining a pair of forwardly extending arms spaced from one another and formed of a first material. An inner member is positioned between the arms of the outer member and is formed of a second material that is more resilient than the first material.

18 Claims, 2 Drawing Sheets

(56) References Cited

U.S. PATENT DOCUMENTS

| | | | | | |
|---|---|---|---|---|---|
| 5,367,791 | A * | 11/1994 | Gross | A43B 13/26 | 36/25 R |
| 5,425,184 | A * | 6/1995 | Lyden et al. | 36/29 | |
| 5,465,509 | A * | 11/1995 | Fuerst et al. | 36/88 | |
| 5,595,004 | A * | 1/1997 | Lyden et al. | 36/29 | |
| 5,625,964 | A * | 5/1997 | Lyden et al. | 36/29 | |
| 5,918,383 | A | 7/1999 | Chee | | |
| 6,038,790 | A * | 3/2000 | Pyle et al. | 36/30 R | |
| 6,041,521 | A | 3/2000 | Wong | | |
| 6,055,746 | A * | 5/2000 | Lyden et al. | 36/29 | |
| 6,082,023 | A * | 7/2000 | Dalton | 36/28 | |
| 6,092,251 | A | 7/2000 | Tomat | | |
| 6,176,025 | B1 | 1/2001 | Patterson et al. | | |
| 6,367,172 | B2 | 4/2002 | Hernandez | | |
| 7,086,179 | B2 * | 8/2006 | Dojan et al. | 36/29 | |
| 7,132,032 | B2 * | 11/2006 | Tawney et al. | 156/290 | |
| 7,168,187 | B2 * | 1/2007 | Robbins | 36/30 R | |
| 7,200,955 | B2 * | 4/2007 | Foxen | 36/25 R | |
| 7,444,767 | B2 * | 11/2008 | Kilgore et al. | 36/30 R | |
| 7,665,230 | B2 * | 2/2010 | Dojan et al. | 36/29 | |
| 7,712,231 | B2 * | 5/2010 | Umezawa et al. | 36/142 | |
| 7,797,856 | B2 * | 9/2010 | Andrews et al. | 36/30 R | |
| 2002/0056208 | A1 * | 5/2002 | Brown | 36/44 | |
| 2003/0051373 | A1 * | 3/2003 | Goodwin | 36/29 | |
| 2004/0020078 | A1 * | 2/2004 | Bray et al. | 36/9 R | |
| 2005/0132608 | A1 * | 6/2005 | Dojan et al. | 36/29 | |
| 2005/0132609 | A1 * | 6/2005 | Dojan et al. | 36/29 | |
| 2005/0132610 | A1 * | 6/2005 | Foxen et al. | 36/29 | |
| 2007/0107257 | A1 * | 5/2007 | Laska | 36/4 | |
| 2007/0294917 | A1 * | 12/2007 | Holden et al. | 36/29 | |
| 2008/0201985 | A1 * | 8/2008 | Dojan et al. | 36/29 | |
| 2008/0244926 | A1 * | 10/2008 | Yu et al. | 36/28 | |
| 2008/0250673 | A1 * | 10/2008 | Andrews et al. | 36/25 R | |
| 2009/0019730 | A1 * | 1/2009 | Salminen et al. | 36/91 | |
| 2009/0049712 | A1 * | 2/2009 | Steszyn | A43B 7/142 | 36/91 |
| 2009/0113767 | A1 * | 5/2009 | Lee | 36/3 B | |
| 2009/0272008 | A1 * | 11/2009 | Nomi et al. | 36/91 | |
| 2010/0263234 | A1 * | 10/2010 | Teteriatnikov et al. | 36/108 | |

OTHER PUBLICATIONS

The Engineeering ToolBox, Material Properties, Solids and Metals-Specific-Gravities, http://www.engineeringtoolbox.com/specific-gravity-solids-metals-d_293.html.*

The Engineering ToolBox, Material Properties, Solids and Metals-Specific-Gravities, http://www.engineeringtoolbox.com/specific-gravity-solids-metals-d_293.html.*

The Engineering ToolBox, Material Properties, Solids and Metals-Specific-Gravities, May 8, 2006, http://www.engineeringtoolbox.com/specific-gravity-solids-metals-d_293.html.*

International Search Report and Written Opinion issued Jul. 20, 2011 in corresponding PCT Application No. PCT/US2011/035475.

Office Action issued in corresponding Chinese Application No. 201180023305.9 mailed Jun. 26, 2014.

Feb. 28, 2015—(CN) Office Action App 201180023305.9.

Mar. 10, 2015—(EP) Office Action App 11719744.2.

* cited by examiner

ARTICLE OF FOOTWEAR WITH MULTI-PART SOLE ASSEMBLY

FIELD

Aspects of this invention relate generally to footwear, and, in particular, to an article of footwear with a multi-part sole assembly.

BACKGROUND

Conventional articles of athletic footwear generally include two primary elements, an upper and a sole structure. The upper is secured to the sole structure and forms a void on the interior of the footwear for comfortably and securely receiving a foot. The sole structure is positioned between the upper and the ground, and it may include a polymer foam midsole and an outsole. The midsole attenuates ground (or other contact surface) reaction forces to lessen stresses upon the foot and leg. The outsole forms a ground-engaging portion (or other contact surface-engaging portion) of the sole structure and is formed from a durable and wear-resistant material. The sole structure also may include a sockliner or an insole member that is positioned within the void and proximate a lower surface of the foot to enhance footwear comfort.

The sole structure generally incorporates multiple layers that are conventionally referred to as an insole, a midsole, and an outsole. The insole is a thin, compressible member located within the upper and adjacent to a plantar (i.e., lower) surface of the foot to enhance footwear comfort. The midsole, which is conventionally secured to the upper along the length of the upper, forms a middle layer of the sole structure and is primarily responsible for attenuating ground reaction forces. The outsole forms the ground-contacting element of footwear and is usually fashioned from a durable, wear-resistant material that includes texturing to improve traction.

The conventional midsole is primarily formed from a resilient, polymer foam material that extends throughout the length of the footwear, often by way of an injection molding process. The properties of the polymer foam material in the midsole are primarily dependent upon factors that include the dimensional configuration of the midsole and the specific characteristics of the material selected for the polymer foam, including the hardness or density of the polymer foam material. By varying these factors throughout the midsole, the relative stiffness and degree of ground reaction force attenuation may be altered to meet the specific demands of the activity for which the footwear is intended to be used. In addition to polymer foam materials, conventional midsoles may include, for example, one or more fluid-filled bladders and moderators.

It would be desirable to provide a sole assembly that reduces or overcomes some or all of the difficulties inherent in prior known devices. Particular advantages will be apparent to those skilled in the art, that is, those who are knowledgeable or experienced in this field of technology, in view of the following disclosure of the invention and detailed description of certain embodiments.

SUMMARY

The principles of the invention may be used to provide an article of footwear with a multi-part sole assembly. In accordance with a first aspect, an article of footwear includes an upper, a midsole beneath the upper, and an outsole beneath the midsole. The midsole includes a substantially U-shaped outer member defining a pair of forwardly extending arms spaced from one another and formed of a first material. An inner member is positioned between the arms of the outer member and is formed of a second material that is more resilient than the first material. A pair of shoulders extends outwardly from a central portion of a forefoot region of the inner member, with a forward end of each arm of the outer member abutting one of the shoulders.

In accordance with another aspect, an article of footwear includes an upper and a midsole positioned beneath the upper and having a substantially U-shaped outer member defining a pair of forwardly extending arms spaced from one another and formed of a first material. An inner member is positioned between the arms of the outer member and is formed of a second material having a hardness that is less than a hardness of the first material. An outsole is positioned beneath the midsole and includes a first retaining wall extending upwardly from an outer peripheral edge of a forefoot region of the outsole and a second retaining wall extending upwardly from an outer peripheral edge of a heel region of the outsole.

In accordance with a further aspect, an article of footwear includes an upper and a midsole positioned beneath the upper and having a substantially U-shaped outer member defining a pair of forwardly extending arms spaced from one another and formed of a first material; and an inner member positioned between the arms of the outer member and formed of a second material having a specific gravity that is less than a specific gravity of the first material. An outsole is positioned beneath the midsole, and includes a first retaining wall extending upwardly from an outer peripheral edge of a forefoot region of the outsole and a second retaining wall extending upwardly from an outer peripheral edge of a heel region of the outsole.

By providing an article of footwear with a multi-part sole assembly according to certain embodiments, a user can be provided with improved stability as well as improved cushioning and support. This is highly advantageous since this can improve the feel and performance of the user's footwear.

These and additional features and advantages disclosed here will be further understood from the following detailed disclosure of certain embodiments.

Figure 1:
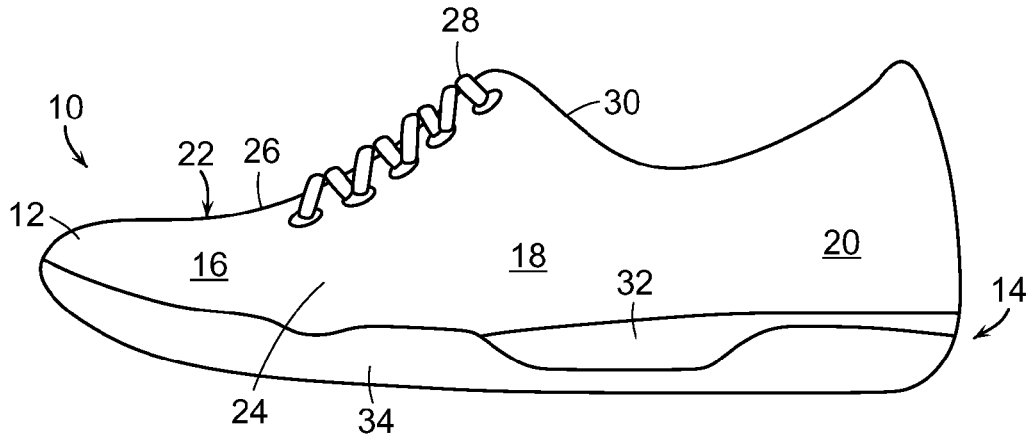
FIG. 1 is a perspective view of an article of footwear with a multi-part sole assembly.

The figures referred to above are not drawn necessarily to scale, should be understood to provide a representation of particular embodiments of the invention, and are merely conceptual in nature and illustrative of the principles involved. Some features of the footwear with a multi-part sole assembly depicted in the drawings have been enlarged or distorted relative to others to facilitate explanation and understanding. The same reference numbers are used in the drawings for similar or identical components and features shown in various alternative embodiments. Footwear with a multi-part sole assembly as disclosed herein would have configurations and components determined, in part, by the intended application and environment in which they are used.

DETAILED DESCRIPTION OF CERTAIN PREFERRED EMBODIMENTS

An article of footwear 10 is depicted in FIG. 1 as including an upper 12 and a sole assembly 14. Article of footwear 10 can be any of various articles of casual footwear having configurations suitable, for example, for walking or lounging. Footwear 10 may also be one of a wide range of athletic footwear styles, including shoes that are suitable for soccer, running, basketball, baseball, cross-training, football, rugby, tennis, and volleyball, for example. An individual skilled in the relevant art will appreciate, therefore, that the concepts disclosed herein with regard to footwear 10 may be applied to a wide variety of footwear styles, in addition to the specific styles discussed herein and depicted in the accompanying figures.

For purposes of reference in the following description, footwear 10 may be divided into three general regions: a forefoot region 16, a midfoot region 18, and a heel region 20. Regions 16-20 are not intended to demarcate precise areas of footwear 10. Rather, regions 16-20 are intended to represent general areas of footwear 10 that provide a frame of reference during the following discussion. Although regions 16-20 apply generally to footwear 10, references to regions 16-20 also may apply specifically to upper 12, sole assembly 14, or individual components within either upper 12 or sole assembly 14.

Upper 12 defines a void or chamber for receiving a foot. For purposes of reference, upper 12 includes a lateral side 22, an opposite medial side 24, and a vamp or instep area 26. Lateral side 22 is positioned to extend along a lateral side of the foot (i.e., the outside) and generally passes through each of regions 16-20. Similarly, medial side 24 is positioned to extend along an opposite medial side of the foot (i.e., the inside) and generally passes through each of regions 16-20. Upper 12 may also include a closure mechanism, such as lace 28. Upper 12 also includes an ankle opening 30 that provides the foot with access to the void within upper 12.

Sole assembly 14 includes a midsole 32 positioned below upper 12. In certain embodiments, midsole 32 is secured to upper 12. Midsole 32 may be secured to upper 12 with an adhesive, for example. Suitable adhesives are well known in the art and need not be discussed in greater detail here. Midsole 32 may be secured to upper 12 with any other suitable fastening means including, for example, stitching, or stitching and adhesive. Other suitable means of fastening midsole 32 to upper 12 will become readily apparent to those skilled in the art, given the benefit of this disclosure.

An outsole 34 is positioned below midsole 32. In certain embodiments, outsole 34 is secured to midsole 32. In other embodiments, outsole 34 may also, or alternatively, be secured to upper 12. Outsole 34 may be secured to midsole 32 and/or upper 12 with an adhesive, for example. Suitable adhesives are well known in the art and need not be discussed in greater detail here. Outsole 34 may be secured to midsole 32 and/or upper 12 with any other suitable fastening means including, for example, stitching, or stitching and adhesive. Other suitable means of fastening outsole 34 to midsole 32 and/or upper 12 will become readily apparent to those skilled in the art, given the benefit of this disclosure.

In certain embodiments, outsole 34 may be formed of green rubber, and may have a hardness between approximately 64 and approximately 70 Asker C. Other suitable materials for outsole 34 will become readily apparent to those skilled in the art, given the benefit of this disclosure.

Figure 2:
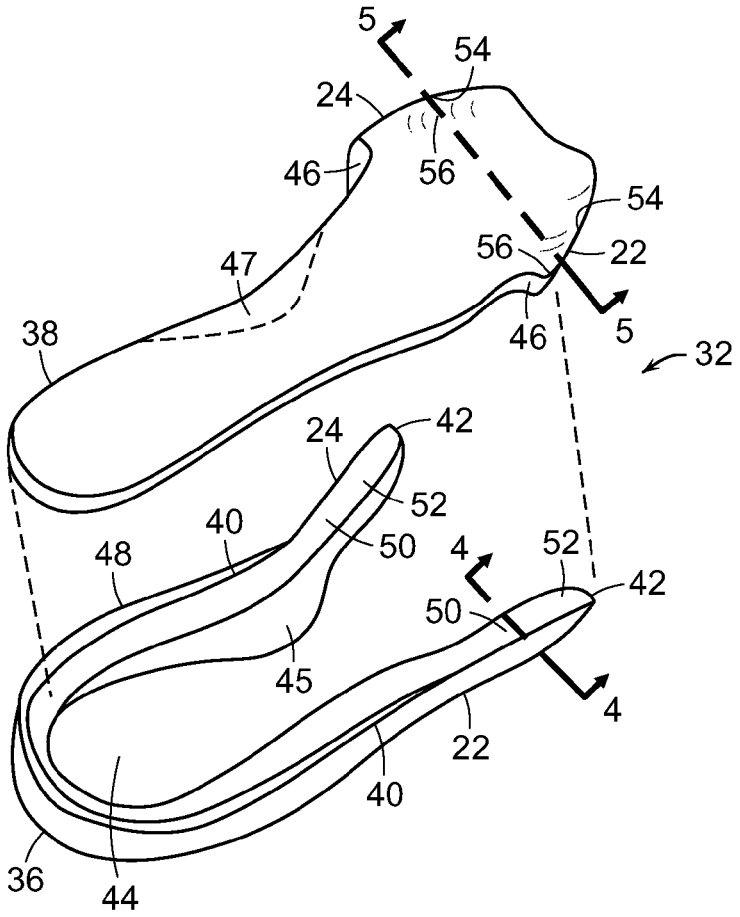
FIG. 2 is an exploded perspective view of the midsole of the article of footwear of FIG. 1.
Figure 3:
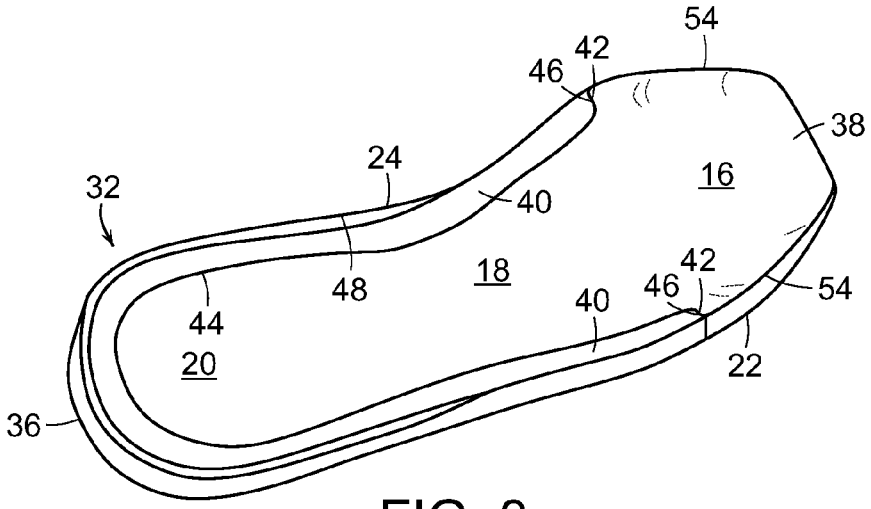
FIG. 3 is perspective view of the midsole of the article of footwear of FIG. 1, shown with its inner and outer members nested together.

An embodiment of midsole 32 is illustrated in exploded form in FIG. 2 and in assembled form in FIG. 3. Midsole 32 includes an outer member 36 and an inner member 38. Outer member 36 is a unitary, that is, one-piece structure that may be substantially U-shaped so as to define a pair of arms 40 having forward ends 42, and spaced from one another and extending substantially along a longitudinal axis L of midsole 32. Arms 40 are not necessarily straight or linear members, but, rather, may be slightly curved to define a peripheral edge of midsole 32 in conventional fashion. Arms 40 define a gap 44 therebetween within which inner member 38 is received.

The entire upper surface of each of outer member 36 and inner member 38 is directly secured to the bottom surface upper 12. Thus, in embodiments in which outer member 36 and inner member 38 are adhesively secured to upper 12, adhesive is positioned between upper 12 and outer member 36 and inner member 38.

Similarly, the entire bottom surface of each of outer member 36 and inner member 38 is directly secured to the upper surface of outsole 34. Thus, in embodiments in which outer member 36 and inner member 38 are adhesively secured to outsole 34, adhesive is positioned between upper 12 and outer member 36 and outsole 34.

Medial arm 40 may have a tongue 45 extending inwardly in midfoot region 18 thereof, with tongue 45 being received in a recess 47 formed on the underside of inner member 38 in a midfoot region 18 thereof. Tongue 45 provides additional support for the user's foot in midfoot region 18.

In certain preferred embodiments, as illustrated in FIGS. 2 and 3, arms 40 extend forwardly only into a central area of forefoot region 16 of midsole 32. In this embodiment, a pair of shoulders 46 extend outwardly from opposed sides of inner member 38 in the forefoot region 16 of inner member 38. Shoulders 46 extend transversely in a direction substantially perpendicular to longitudinal axis L. Forward ends 42 of arms 40 abut shoulders 46, as seen in FIG. 3.

Figure 4:
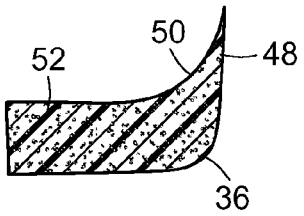
FIG. 4 is a section view of the inner member of the midsole shown in FIG. 2, taken along lines 4-4.

As seen in FIG. 4, outer member 36 may include a first lip 48 about its upper peripheral edge. An inner surface 50 of lip 48 may curve upwardly from an upper surface 52 of outer member 36.

Figure 5:
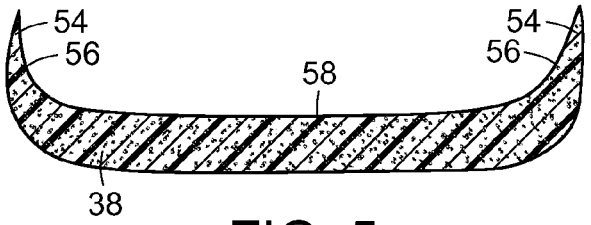
FIG. 5 is a section view of the outer member of the midsole shown in FIG. 2, taken along lines 5-5.

Similarly, as seen in FIG. 5, inner member 38 may have second lips 54 extending upwardly from the lateral peripheral edge and the medial peripheral edge of forefoot region 16 of inner member 38. Inner surfaces 56 of lips 54 may curve upwardly from an upper surface 58 of inner member 38.

Outer member 36 is formed of a first material and inner member 38 is formed of a second material that is different from the first material. Providing different materials allows midsole 34 to be customized or optimized to provide particular performance characteristics. For example, by making the first material stiffer and less resilient than that of the second material, the peripheral portion of midsole 32 can provide more support and stability for the user's foot.

In preferred embodiments, the first material has a specific gravity and a hardness that are greater than those of the second material. In certain embodiments the hardness of the first material is between approximately 51 and approximately 55 Asker C. In certain embodiments the specific gravity of the first material is approximately 0.19 and approximately 0.22.

In certain embodiments, the first material is formed of phylon (Ethylene Vinyl Acetate ('EVA') foam or injection phylon. Phylon may be made of EVA foam pellets, slabs, or sheets that are compressed, heat expanded, and then cooled in a mold. Other suitable first materials will become readily apparent to those skilled in the art, given the benefit of this disclosure.

By providing the second material with a specific gravity and hardness less than that of the first material, the inner portion of midsole 32, that is, inner member 38, provides the footwear user(s) with an inner area or region of midsole 32 that is softer and more responsive than the peripheral area or region provided by outer member 36. The second material used to form inner member 38 may be injection phylon, or polyurethane (PU). The PU may be injected into a first mold and then expanded to produce a preform, which is then compressed in a second mold. Other suitable second materials will become readily apparent to those skilled in the art, given the benefit of this disclosure.

In certain embodiments the hardness of the second material is between approximately 46 and approximately 50 Asker C. In certain embodiments the specific gravity of the first material is approximately 0.12.

In other embodiments, the second material may be a foam material prepared from a mixture of hydrogenated or non-hydrogenated acrylonitrile-butadiene copolymer; modified hydrogenated acrylonitrile-butadiene copolymer; and alpha olefin copolymer. The foam material used in embodiments described herein may have a density of less than 0.25 g/cc$^2$ and a hardness of between approximately 20 and approximately 30 Asker C. Further description of such a foam material is found in U.S. patent application Ser. No. 11/752,348, entitled "Article of Footwear with Lightweight Sole Assembly," filed on May 23, 2007, the entire disclosure of which is incorporated herein by reference.

Figure 6:
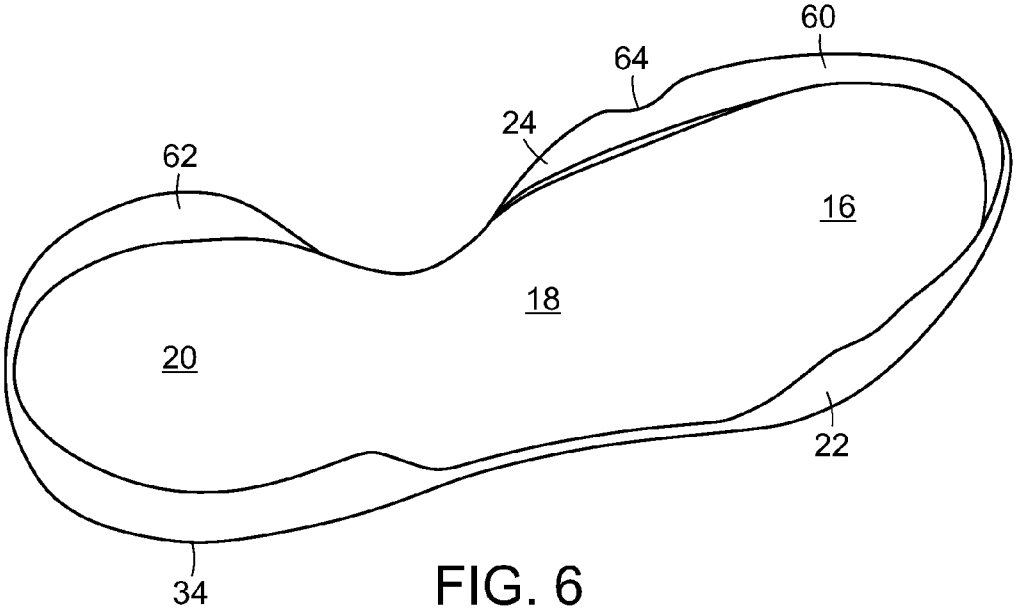
FIG. 6 is a perspective view of the outsole of the article of footwear of FIG. 1.

Outsole 34 of sole assembly 14, as seen in FIG. 6, may include a first retaining wall 60 extending upwardly from a peripheral edge of forefoot region 16 of outsole 34. In certain embodiments, first retaining wall 60 extends rearwardly along medial side 24 of forefoot region 16 further than it extends rearwardly along lateral side 22 of forefoot region 16. First retaining wall 60 serves to provide enhanced protection and durability for forefoot region 16, which is a particularly useful for sports such as soccer, for example.

Outsole 34 may include a second retaining wall 62 extending upwardly from a peripheral edge of heel region 20 of outsole 34. Midsole 32 is positioned above and on outsole 34 and is nested between/within first retaining wall 60 and second retaining wall 62. Second retaining wall 62 serves to provide enhanced stability for cutting and other lateral movements as well as improved rigidity for footwear 10.

In certain embodiments, a notch 64 may be formed in first retaining wall 60, at its upper edge on medial side 24 of forefoot region 16 of outsole 34. Notch 64 serves to provide additional flexibility for outsole 34 proximate the ball of the user's foot, facilitating bending of forefoot region 16 of footwear 10 when the user is walking or running.

First and second retaining walls 60, 62 of outsole 34 serve to provide additional support and stability for footwear 10. By being positioned about the exterior of midsole 32, first and second retaining walls 60, 62 retain inner member 38 and outer member 36, thereby reducing their tendency to spread out when under compression, which in turn minimizes energy loss.

In certain embodiments, outsole 34 may have a hardness of between approximately 64 and approximately 70 Asker C. In certain embodiments, outsole 34 may be formed of green rubber. Other suitable materials for outsole 34 will become readily apparent to those skilled in the art, given the benefit of this disclosure.

Thus, while there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. An article of footwear comprising:

an upper defining a chamber for receiving a foot;

a midsole positioned beneath and directly secured to the upper and comprising:

a substantially U-shaped outer member defining a pair of forwardly extending arms spaced from one another and formed of a first material, and including a tongue extending inwardly from a midfoot region of a medial arm of the pair of arms; and an inner member positioned between the arms of the outer member and formed of a second material that is different from the first material, a pair of shoulders extending outwardly from a central portion of a forefoot region of the inner member in a direction substantially perpendicular to a longitudinal axis of the midsole, a forward end of each arm of the outer member abutting one of the shoulders, a recess being formed on an underside of a lateral side of the inner member, the recess receiving the tongue of the outer member; and an outsole positioned beneath the midsole and including a first retaining wall extending upwardly from an outer peripheral edge of an upper surface of the outsole and a second retaining wall extending upwardly from the outer peripheral edge of the upper surface of the outsole, each of a first end of the first retaining wall being spaced from a first end of the second retaining wall and a second end of the first retaining wall being spaced from a second end of the second retaining wall by portions of the upper surface of the outsole free of a retaining wall;

wherein an interior of the first retaining wall extends along an exterior of the midsole in uninterrupted fashion from a medial side of the midsole and around a forefoot of the midsole to a lateral side of the midsole; and wherein an interior of the second retaining wall extends along an exterior of the midsole in uninterrupted fashion from a medial side of the midsole and around a heel portion of the midsole to a lateral side of the midsole.

2. The article of footwear of claim 1, wherein the second material is more resilient than the first material.

3. The article of footwear of claim 1, wherein the second material has a hardness that is less than a hardness of the first material.

4. The article of footwear of claim 1, wherein the first material is ethylene vinyl acetate (EVA).

5. The article of footwear of claim 1, wherein the second material is ethylene vinyl acetate (EVA).

6. The article of footwear of claim 1, wherein the second material is polyurethane (PU).

7. The article of footwear of claim 1, wherein the first retaining wall extends about a peripheral edge of a forefoot region of the outsole.

8. The article of footwear of claim 7, wherein the first retaining wall extends rearwardly along a medial side of the outsole a greater distance than an amount that the first retaining wall extends rearwardly along a lateral side of the of the outsole.

9. The article of footwear of claim 1, wherein the second retaining wall extends about a peripheral edge of a heel region of the outsole.

10. The article of footwear of claim 1, wherein the midsole is secured to the upper.

11. The article of footwear of claim 1, wherein the outsole is secured to the midsole.

12. The article of footwear of claim 1, further comprising a first lip extending upwardly along a peripheral edge of the inner member.

13. The article of footwear of claim 12, wherein the first lip extends about a peripheral edge of a forefoot region of the inner member.

14. The article of footwear of claim 12, further comprising second lips extending upwardly along a peripheral medial edge and a peripheral lateral edge of a forefoot region of the outer member.

15. The article of footwear of claim 1, wherein the arms extend forwardly to a forefoot region of the midsole.

16. An article of footwear comprising:

an upper defining a chamber for receiving a foot;

a midsole positioned beneath and directly secured to the upper and comprising:

a substantially U-shaped outer member defining a pair of forwardly extending arms spaced from one another and formed of a first material, and including a tongue extending inwardly from a midfoot region of a medial arm of the pair of arms; and an inner member positioned between the arms of the outer member and formed of a second material having a hardness that is less than a hardness of the first material, a pair of shoulders extending outwardly from a central portion of a forefoot region of the inner member in a direction substantially perpendicular to a longitudinal axis of the midsole, a forward end of each arm of the outer member abutting one of the shoulders, a recess being formed on an underside of a lateral side of the inner member, the recess receiving the tongue of the outer member; and an outsole positioned beneath the midsole and including a first retaining wall extending upwardly from an outer peripheral edge of a forefoot region of an upper surface of the outsole and a second retaining wall extending upwardly from an outer peripheral edge of a heel region of the upper surface of the outsole, each of a first end of the first retaining wall being spaced from a first end of the second retaining wall and a second end of the first retaining wall being spaced from a second end of the second retaining wall by portions of the upper surface of the outsole free of a retaining wall;

wherein an interior of the first retaining wall extends along an exterior of the midsole in uninterrupted fashion from a medial side of the midsole and around a forefoot of the midsole to a lateral side of the midsole; and wherein an interior of the second retaining wall extends along an exterior of the midsole in uninterrupted fashion from a medial side of the midsole and around a heel portion of the midsole to a lateral side of the midsole.

17. The article of footwear of claim 16, further comprising a first lip extending upwardly along a peripheral edge of a forefoot region of the inner member.

18. An article of footwear comprising:

an upper defining a chamber for receiving a foot;

a midsole positioned beneath and directly secured to the upper and comprising:

a substantially U-shaped outer member defining a pair of forwardly extending arms spaced from one another and formed of a first material, and including a tongue extending inwardly from a midfoot region of a medial arm of the pair of arms; and an inner member positioned between the arms of the outer member and formed of a second material having a specific gravity that is less than a specific gravity of the first material, a pair of shoulders extending outwardly from a central portion of a forefoot region of the inner member in a direction substantially perpendicular to a longitudinal axis of the midsole, a forward end of each arm of the outer member abutting one of the shoulders, a recess being formed on an underside of a lateral side of the inner member, the recess receiving the tongue of the outer member; and an outsole positioned beneath the midsole, and including a first retaining wall extending upwardly from an outer peripheral edge of a forefoot region of an upper surface of the outsole and a second retaining wall extending upwardly from an outer peripheral edge of a heel region of the upper surface of the outsole, each of a first end of the first retaining wall being spaced from a first end of the second retaining wall and a second end of the first retaining wall being spaced from a second end of the second retaining wall by portions of the upper surface of the outsole free of a retaining wall;

wherein an interior of the first retaining wall extends along an exterior of the midsole in uninterrupted fashion from a medial side of the midsole and around a forefoot of the midsole to a lateral side of the midsole; and wherein an interior of the second retaining wall extends along an exterior of the midsole in uninterrupted fashion from a medial side of the midsole and around a heel portion of the midsole to a lateral side of the midsole.

* * * * *